US008348371B2

(12) United States Patent
McDowell et al.

(10) Patent No.: US 8,348,371 B2
(45) Date of Patent: Jan. 8, 2013

(54) UTILIZING A PRINTER TO CUSTOMIZE APPAREL IN A RETAIL FACILITY

(75) Inventors: Sean McDowell, Andover, MA (US); Steve Horn, New York, NY (US); Dave Powers, North Andover, MA (US); Brandon Avery, North Andover, MA (US); Bryan Cioffi, North Andover, MA (US)

(73) Assignee: Converse Inc., North Andover, MA (US)

( * ) Notice: Subject to any disclaimer, the term of this patent is extended or adjusted under 35 U.S.C. 154(b) by 435 days.

(21) Appl. No.: 12/615,834

(22) Filed: Nov. 10, 2009

(65) Prior Publication Data

US 2011/0109686 A1 May 12, 2011

(51) Int. Cl.
*B41J 29/00* (2006.01)
*B41J 2/07* (2006.01)

(52) U.S. Cl. ..... 347/14; 347/104

(58) Field of Classification Search ..... None
See application file for complete search history.

(56) References Cited

U.S. PATENT DOCUMENTS 4,807,143 A 2/1989 Matsuura
5,594,652 A 1/1997 Penn et al.
5,673,499 A 10/1997 Attilieni
5,930,810 A 7/1999 Farros et al.
2002/0082953 A1 6/2002 Batham et al.
2002/0133261 A1 9/2002 Fard
2005/0071242 A1 3/2005 Allen et al.
2007/0043582 A1 2/2007 Peveto et al.
2008/0147219 A1 6/2008 Jones et al.

OTHER PUBLICATIONS

International Search Report and Written Opinion for International Application PCT/US2010/56211, mailed Jan. 13, 2011.

*Primary Examiner* — Jerry Rahll
(74) *Attorney, Agent, or Firm* — Shook, Hardy & Bacon L.L.P.

(57) ABSTRACT

Customized articles of footwear are produced by providing options and graphics that are selected by a customer when submitting a custom order at a retail facility. The graphics are selected from a catalog while the options, such as a shoe model or a shoe size, are selected at an order interface rendered at a computing device. The computing device processes the order by uploading printing instructions associated with the customer-selected graphic or by converting specifications of the order into the printing instructions. The printing instructions are passed to a printer that is configured to move inkjet nozzles in a pattern and, concurrently, control a timed release of coloring agent from the inkjet nozzles based on the printing instructions. Releasing the coloring agent over the article of footwear physically applies a design thereto, which substantially resembles the customer-selected graphic. An oven typically cures the design via infrared heat over a time-frame.

20 Claims, 6 Drawing Sheets

UTILIZING A PRINTER TO CUSTOMIZE APPAREL IN A RETAIL FACILITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The basic structure surrounding the manufacture and retail of apparel (e.g., clothing, articles of footwear, accessories, and the like) has changed little over the past several decades. Under this structure, a piece of apparel is produced in one location and sold in another. These two locations are removed from each other and rarely interact beyond shipping products therebetween. For instance, shoes are typically designed and built to completion prior to being shipped to a retail facility (e.g., shoe store). As such, potential customers are offered a limited selection of shoe designs at the retail facility, even when the tastes of the potential customers may vary dramatically. As such, employing emerging technologies, such as inkjet printers that can physically apply buyer-selected graphics to various substrates, to customize apparel within a retail facility (e.g., shoe store) would enhance the potential customer's experience when shopping for and selecting the apparel.

SUMMARY

This Summary is provided to introduce concepts in a simplified form that are further described below in the Detailed Description. This Summary is not intended to identify key features or essential features of the claimed subject matter, nor is it intended to be used as an aid in determining the scope of the claimed subject matter.

Embodiments of the present invention introduce technology to improve a customer's retail experience by allowing the customer to select and customize a piece of apparel within a retail facility (e.g., shoe store). Customizing the piece of apparel might include, for instance, selecting a graphic to be applied to an article of footwear. The graphic could be selected from a catalog of predefined images (e.g., logos, symbols, team emblems, and the like) and/or words (e.g., names of people, brand names, expressions, and the like), could be submitted by the customer in a digital format, or could be drawn on a tablet device within the context of the retail facility. If the graphic is selected from a catalog, a barcode corresponding the graphic is scanned by an operator, typically behind a sales counter, and an order for the customized article of footwear is established.

In addition, the customer is prompted to select the article of footwear from an array of various models and sizes that are available at the retail facility. In an embodiment where the customer is ordering remotely, an even broader range of types and styles of footwear may be offered for selection. Upon selecting an appropriate model and size of the article of footwear, the selected article of footwear can be manually placed into a loading zone of a printer. Often, placing the article of footwear into the loading zone involves assembling the article of footwear to a fixture (e.g., shoe platen) that holds a portion of the article of footwear in a relatively taut state, such that the portion assumes a substantially flattened condition. This assembly may be placed in the loading zone and a physical application of the selected design to the portion of the article of footwear can commence.

Initially, physically applying the design includes one or more of the following steps: converting the graphic into printing instructions; conveying the printing instructions to the printer; and invoking the printer to being executing the printing instructions. During execution of the printing instructions, the printer is configured to concurrently move an inkjet nozzle to distribute ink in a pattern with respect to the article of footwear and control a timed release of a coloring agent from the inkjet nozzle. The released coloring agent physically applies the design on the portion of the article of footwear. Typically, the pattern printed by the inkjet nozzle and the timing of the release of the coloring agent is governed by the printing instructions. Upon completion, the design substantially replicates the graphic selected by the customer.

Incident to the design being physically applied to the article of footwear, the article of footwear bears the design in an uncured condition. In embodiments, an oven is used to accelerate drying of the design, thereby reducing the timeframe needed to carry out the customization process. In one instance, the oven includes a chamber for receiving the piece of apparel. When activated, the oven is configured to uniformly heat (e.g., using infrared technology) the piece of apparel until the design reaches a cured condition. At this point, based on specifications within the order, the article of footwear may proceed to a finishing station where additional operations (e.g., adding studs, grommets, holes, jewels, laces, and the like) can occur. Upon completion of the order within the retail facility, the customized article of footwear is presented to the customer at the sales counter. As such, embodiments of the present invention allow a customer to enter the retail facility, place an order to customize an article of footwear, or any other piece of apparel, and obtain the customized article of footwear in a matter of minutes from the initial entry, where the customized article of footwear is in a ready-to-wear condition.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
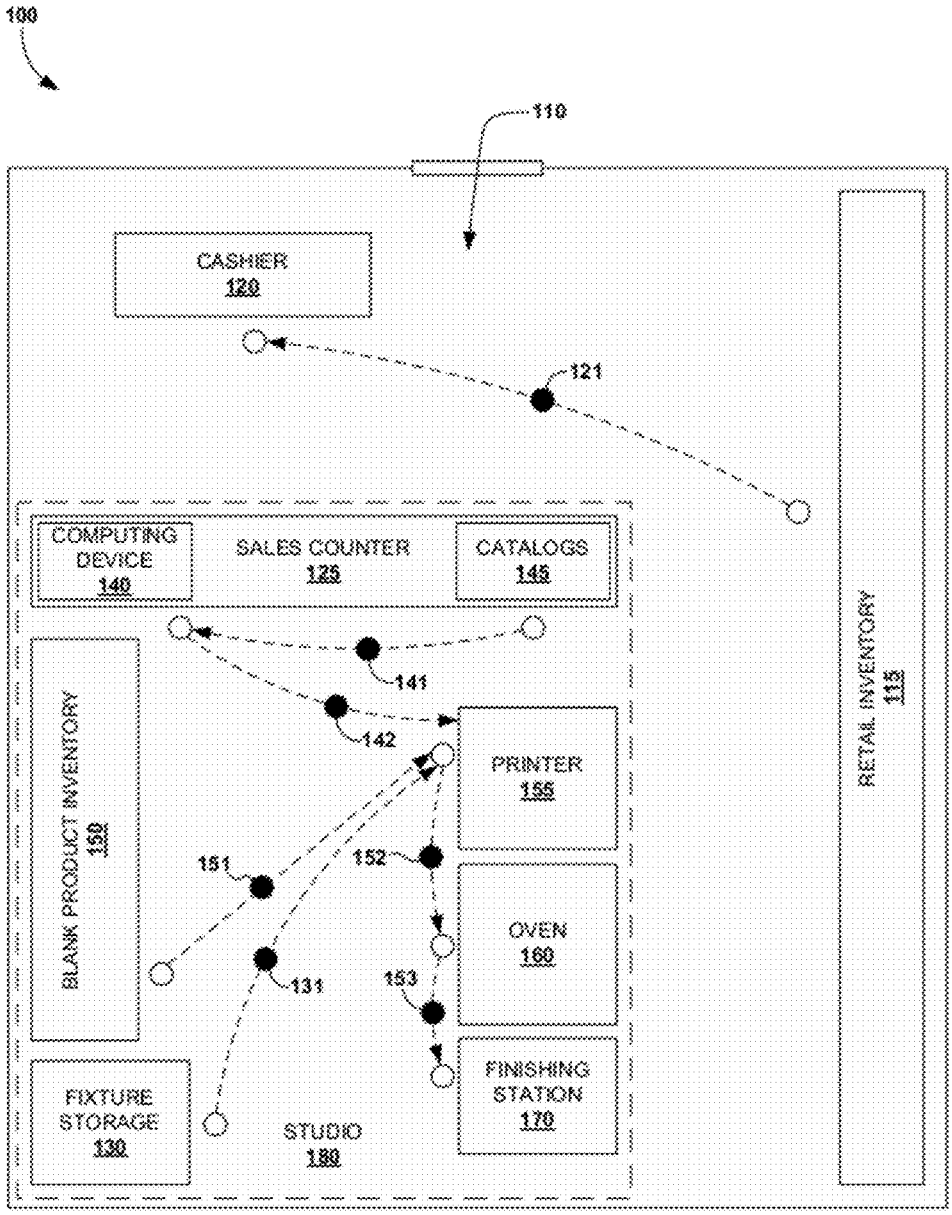
FIG. 1 is a schematic diagram of an exemplary floor plan of a retail facility suitable for use in implementing embodiments of the present invention.

The subject matter is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Embodiments, of the present invention generally relate to enhancing a potential customer's retail experience when selecting and purchasing a piece of apparel. More particularly, some embodiments of the present invention relate to on-site customization of the piece of apparel based the potential customer's preferences.

In one aspect, embodiments of the present invention relate to a system for performing a method for customizing a piece of apparel in a retail facility according to an order placed by a customer. Initially, the system includes at least a computing device, a printer, and an oven, which are each located in the retail facility. The computing device is configured to receive the order submitted by the customer and to convert the order into printing instructions. Typically, the order includes one or more graphics selected by the customer. In an exemplary embodiment, the computing device is further configured to deliver the printing instructions to a printer.

The printer is configured to receive at least a portion of the piece of apparel within a loading zone. Also, the printer may be configured to read and execute the printing instructions. Executing the printing instructions causes an inkjet nozzle of the printer to distribute ink in a pattern with respect to the piece of apparel, and, during the movement of the inkjet nozzle, the printing instructions govern a timed release of a coloring agent from the inkjet nozzle. Applying the coloring agent to the portion of the piece of apparel physically applies a design thereto. Typically, the design substantially replicates the graphic(s) selected by the customer. The oven includes a chamber for receiving the piece of apparel incident to the design being physically applied. That is, immediately after being applied, the design resides in an uncured, or wet, condition. In an exemplary embodiment, the oven is configured to heat the piece of apparel until the design reaches a cured condition.

In another aspect, embodiments of the present invention relate to an article of footwear that is customized according to an order placed by a customer. In embodiments, the process of customizing involves receiving the order at an order interface rendered by a computing device, and converting specifications of the order into printing instructions. Generally, the specifications pertain to one or more graphics selected by the customer. In other instances, the specifications may include a model and a size of the article of footwear or an indicia of a portion of the article of footwear targeted for receiving a design.

The customization process may further involve distributing the printing instructions to a printer. In embodiments, the printer is configured to read the printing instructions, to manipulate operation of at least one inkjet nozzle based on the printing instructions, and to time a release of a coloring agent from the inkjet nozzle based on the printing instructions. Upon concurrently moving the inject nozzle and releasing the coloring agent therefrom, a design is physically applied to the article of footwear. In most cases, the design generally resembles the graphic(s) selected by the customer and incorporated in the specifications of the order.

In yet another aspect, embodiments of the present invention relate to a computerized method for customizing an article of footwear according to an order placed by a customer. In a particular instance, the method involves receiving the order for the customized article of footwear at an order interface. An exemplary procedure for receiving the order may include one or more the following steps: (a) presenting models and sizes of the article of footwear; (b) detecting a selection of a model and a size from the presented models and the presented sizes, respectively; (c) identifying a selection of one or more graphics; (d) receiving an indication of a position and a rotational orientation of the selected graphics with respect to the article of footwear; and (e) compiling the size, the model, the selected graphics, and the position and the rotational orientation thereof into the order. The method may further include the steps of utilizing a content filter to determine whether the selected graphics meet predetermined criteria and, upon ascertaining that the selected graphics satisfy the predetermined criteria, converting the order into printing instructions. The printing instructions may be transmitted to a printer for execution thereof. Upon executing the printing instructions, the printer causes a design to be physically applied to the article of footwear (exhibiting the size and the model selected by the customer), where the design generally resembles the selected graphics. Further, the design is substantially arranged in the position and the rotational orientation on the article of footwear as specified by the order.

Having briefly described an overview of embodiments of the present invention, an exemplary operating environment suitable for implementing embodiments of the present invention is described below.

Turning now to FIG. 1, a schematic diagram is illustrated that shows an exemplary floor plan 100 of a retail facility suitable for use in implementing embodiments of the present invention. It will be understood and appreciated that the floor plan 100 shown in FIG. 1 is merely an example of one suitable arrangement of inventory and equipment within a retail environment and is not intended to suggest any limitation as to the scope of the embodiments of the present invention. Neither should the floor plan be interpreted as having any dependency or requirement related to any single piece of equipment or combination of equipment and inventory illustrated therein. Further, although the various blocks of FIG. 1 are shown with lines for the sake of clarity, in reality, delineating various pieces of equipment is not so clear (e.g., printer 155 and oven 160 may be assembled as a single unit).

As used herein, the phrase "retail facility" is not meant to be limiting, but may encompass a wide range of accommodations for housing the equipment illustrated in FIG. 1. By way of example, the retail facility may be a store, a standalone structure, a room that shares at least one wall with another room, a private residence, a public area, a moveable unit, etc. As such, although a single configuration of the retail facility is depicted by the floor plan 100, it should be understood and appreciated that other types of suitable arrangements of equipment and inventory within the space provided by any form of retail facility may be used, and that embodiments of the present invention are not limited to the rectangular area described herein. By way of example, the retail facility may be a vehicle that travels to sporting events or concerts, which is capable of customizing pieces of apparel with designs that are relevant to the venue where the vehicle is presently located.

As illustrated in the exemplary retail facility of FIG. 1, the floor plan 100 includes an entryway 110, retail inventory 115, a cashier 120, and a studio 180 for customizing pieces of apparel in-store. The floor plan 100 shows the studio 180 as occupying a space in a rear corner of the retail facility; however, the studio 180 may be established within any space of the retail facility, or may be distributed throughout the retail facility, or across multiple retail facilities. Initially, the studio 180 includes such equipment and inventory as a sales counter 125 that accommodates a computing device 140 and one or more catalogs 145, a fixture storage 130, a selection of blank product inventory 150 of various models and sizes, a printer 155, an oven 160, and a finishing station 170. Although only one of each component of the studio is shown in FIG. 1, any number of components may be employed to achieve the desired functionality within the scope of embodiments of the present invention. For instance, based on the capacity and speed of the printer 155, a plurality of ovens 160 may be utilized to support an efficient and consistent work flow, or vice versa.

Initially, the sales counter 125 may be any structure at which an operator (e.g., store employee, trained specialist, salesperson, and the like) can be present in order to easily interface with a potential customer that has come into the retail facility via the entryway 110. As discussed above, the computing device 140 and the catalog(s) 145 are arranged in proximity to the sales counter 125, as these pieces of equipment are usually used in the primary steps of the customization process. The catalog 145 may include a multitude of graphics represented therein. As used herein, the term "graphics" generally refers to a two-dimensional visual impression, such as designs, patterns, logos, multi-color images (e.g., high school mascots), monotone images, symbols (e.g., representing a holiday, season, or special day of the year), indicia of an organization (e.g., private company, charity, or social group), text, phrases in one or more languages, expressions, names, team emblems, strings of alpha-numeric characters, ornamentation, decoration, diagrams, pictures, photos, markings, or any combination thereof. By way of example, a single graphic may be a number donned by a famous athlete in conjunction with the name of the athlete above or below the number.

The catalog 145 may include any number of graphics, and may organize the graphics in any manner. In one instance, the graphics are organized by preferences of particular demographics. By way of example, the graphics may be organized to group those graphics that are popular with teenagers in a particular section of the catalog 145. In another example, graphics that are of interest to women are grouped in a particular section of the catalog 145. As described with respect to FIG. 1, the catalog 145 is in the form of a physical object, such as a book or pamphlet. However, the catalog 145 may be configured in a digital format, such as a document or webpage that includes digital content, which is stored in a memory location of the computing device 140, a data store, and/or a server, as more fully discussed with reference to FIG. 2.

Beyond publishing a plurality of graphics, or representations thereof, the catalog 145 may include a plurality of bar codes that correspond with the plurality of graphics, respectively. In other words, each graphic is associated with a particular barcode that is not duplicative of another barcode within the catalog 145. The association between the graphic and the barcode may be made by proximity of the barcode to the graphic on a page of the catalog 145, by an index of the catalog 145, or any other method for linking one item in the catalog 145 to another. In operation, a barcode 141 within the catalog 145 may be scanned (utilizing a scanning device 210 of FIG. 2). An indicia of the scanned barcode 141 may be communicated to the computing device 140, which identifies the graphic that corresponds to the scanned barcode 141. Upon communication of the barcode 141, the computing device 140 establishes an order that is composed of specifications. One or more of these specifications pertain to the graphic(s) selected by the customer, while other specifications may relate to a size, model, type, or style of a selected piece of apparel.

Although a single embodiment of a means for communicating a customer-selected graphic is selected by the customer has been described, it should be understood and appreciated that other types of suitable mechanisms that identify the customer-selected graphic may be used, and that embodiments of the present invention are not limited to simply barcodes, as described herein. By way of example, a radio-frequency transmitter may be positioned beneath a graphic in the catalog 145, which, when activated, broadcasts a wireless signal that includes an identifier of the customer-selected graphic.

Upon scanning the barcode 141, the order is established in the computing device 140. The order 140 may then be modified upon the customer or the operator selecting additional options. In an exemplary embodiment, the order is modified upon the computing device 140 rendering an order interface at a monitor and accepting selections of options at the order interface. In particular, with respect to the example of customizing article of footwear, the computing device 140 is capable of retrieving the options (e.g., shoe model options or shoe size options) from local memory or a remote data store, rendering the retrieved options within the order interface, and receiving selections indicated by the customer or the operator that are directed toward one or more of the options.

Other types of options may also be available for manipulating the order 140. For instance, the customer or operator may provide an indication of a position or a rotational orientation of the selected graphic, with respect to the article of footwear, at the order interface. This process for targeting a portion of the article of footwear for placement of the graphic is described more fully below with reference to FIG. 3. Accordingly, the order interface at the retail facility promotes in-store interaction between the customer and a final product being built and improves the customer's purchasing experience by granting the customer control of the final product's customizations.

Upon selecting the appropriate options, the computing device 140 may compile the size, the model, the selected graphics, and the position and/or the rotational orientation of the selected graphics into a final version of the order. These selected options within the order, as well as other data used to properly process the order, are referred to herein as the specifications of the order. When the final version of the order is generated, printing instructions 142 are accessed or developed to implement the process of physically applying a design to a selected article of footwear 151. In embodiments, the printing instructions 142 refer to transferable data (e.g., a binary string of code that is readable by the printer 155) that, when executed, guide one or more operations of the printer 155. If the order includes a graphic that is selected from the catalog 145 or pre-established in the computing device 140, the printing instructions 142 corresponding to the graphic may be downloaded from a memory location, either local or remote. Otherwise, when the selected graphic is not recognized by the computing device 140, such as a custom-design graphic provided by the customer, the graphic is dynamically converted into printing instructions 142 at the computing device 140. In this instance, the specifications of the order may also be used to drive aspects of the printing instructions 142. By way of example, the specifications related to the size of the article of footwear may drive a size of the graphic being placed thereon.

Upon accessing or generating the printing instructions 142, they may be communicated from the computing device 140 to the printer 155. The printer 155 is generally configured to receive at least a portion of the selected article of footwear 150 within a loading zone and to physically apply a design to a targeted portion of the selected article of footwear 150 in compliance with the printing instructions 142. In one embodiment, the printer 155 may be an inkjet printer (e.g., Brother® 500 Series or 700 Series printers) that can print on a variety types of materials and substrates. Further, the printer 155 typically includes inkjet nozzles that can distribute a coloring agent in a pattern on the selected article of footwear 151, and can deliver a coloring agent to a targeted portion of the selected article of footwear 151 through the inkjet nozzles. In an exemplary embodiment, both the pattern of movement of the inkjet nozzles and a timed release of the coloring agent through the inkjet nozzles is governed by the printing instructions 142.

Although a single configuration of the printer 155 has been described, it should be understood and appreciated by those of ordinary skill in the art that other types of suitable printing devices that propel variable-sized droplets of liquid coloring agent or fluid materials (e.g., ink) directly onto a substrate may be used, and that embodiments of the present invention are not limited to those inkjet printers described herein. Further, as used herein, the phrase "coloring agent" is not meant to be limiting, but may refer to any aqueous inks, solvent-based inks, mixtures including dyes or pigments, paints, or substances that can be transported to a substrate in a carrier fluid and that effect a change of color on the substrate.

Subsequent to, or in tandem with, sending the printing instructions 142 to the printer 155, the selected article of footwear 151 is removed from the blank product inventory 150. This article of footwear 151 is selected based on specifications in the order, or by simply identifying the article of footwear 151 on a rack or shelving system. As such, the blank product inventory 150 includes any structure or storage unit that is capable of holding products that can be customized.

Upon selecting the article of footwear 151 and removing it from the blank product inventory 150, it is combined with a fixture 131 removed from the fixture storage 130. In one instance, the fixture 131 is a shoe platen that can be first coupled to the loading zone of the printer 155 and then assembled to the selected article of footwear 151. In another instance, the fixture 131 and the selected article of footwear 151 are assembled at some time prior to being placed in the loading zone of the printer 155. In a particular example, a section of the fixture 131 is inserted into two selected articles of footwear 151 (complete pair of shoes) when being installed in the loading zone of the printer 155. Although discussed as being assembled to a pair of shoes and being configured as a shoe platen, the fixture 131 may assume any shape that holds at least one portion of any number of pieces of apparel in a relatively flat orientation. For instance, the fixture 131 may be selected from the fixture storage 130 for assembly to a hooded sweatshirt, which is selected from the blank product inventory 150 based on the order. In another instance, a the fixture 131 may be a universal jigging system that is pre-installed in the loading zone of the printer 155 and that accepts a wide variety of sizes and models of articles of footwear.

Once the assembly of the fixture 131 and the selected article of footwear 151 is installed in the loading zone of the printer 155, and the printing instructions 142 are communicated to the printer 155, execution of the printing instructions 142 may begin. As discussed above, during execution of the printing instructions 142, the printer 155 is configured to manage a pattern of movement of inkjet nozzles based on the printing instructions 142, and to time a release of the coloring agent from the inkjet nozzles based on the printing instructions 142. Typically, the coloring agent is released onto a panel or section of the selected article of footwear 151 that resides in a relatively flat orientation. In embodiments, this flat orientation is achieved by the fixture 131 stretching the panel or section of the selected article of footwear 151 relatively taut. In another embodiment, the panel or section is not completely flat and includes undulations. This panel or section may be blank, in order to highlight the design being physically applied thereto, and generally corresponds to the portion of the selected article of footwear 151 that is targeted by the order to receive the graphic.

When the execution of the printing instructions 142 is complete, the design is physically applied to the article of footwear 151, where the design resembles the selected graphic. At this point, the design is still relatively wet and in an uncured condition. In order to accelerate the drying of the design that is affixed to the selected article of footwear 151, the customized article of footwear 152 is removed from the loading zone of the printer 155 and placed in the oven 160 for accelerated curing. Generally, the oven 160 is configured to dry the newly-printed, customized article of footwear 152 using infrared, conduction-type heating to ensure the design in the uncured condition is not distorted, smudged, or otherwise altered from the initial physical application at the printer 155. The heating process continues until the design reaches a cured condition. In the cured condition, the ink or coloring agent within the design is embedded into the substrate that comprises the section or panel of the customized article of footwear 152 where the design is applied. By way of example, in an embodiment where the customized article of footwear 152 is a canvas shoe, the coloring agent enters into fibers of the canvas in the cured condition so that the operator can remove a cured article of footwear 153 without causing damage to the design.

In an exemplary embodiment, the oven 160 includes a chamber that can hold a number of customized articles of footwear 152. This chamber may be configured as a drawer to provide rapid access to the chamber and to facilitate efficient loading and unloading of the customized articles of footwear 152. By way of example, the oven 160 may be an industrial conveyor oven with a digital temperature control, such as those manufactured by HIX Corp., of Pittsburg, Kans., which can cure a design in a shortened period of time (e.g., about one minute). In other embodiments, the oven 160 may be configured as a heat gun, convection oven, a heat press apparatus, and the like.

When the cured article of footwear 153 is removed from the oven 160, the cured article of footwear 153 may be delivered to a finishing station 170, as indicated by the order. The finishing station 170 is provided to modify the cured article of footwear 153 in accordance with the specifications of the order, where the modifications may include one or more of the following: adding studs, adding jewels, perforating holes, attaching grommets, lacing specialized laces, or applying additional coloring agent. Accordingly, a variety of customizations may be made to the cured article of footwear 153 beyond physically applying a design that matches a customer-selected graphic.

In embodiments, the tools and items used to modify the cured article of footwear 153 may be provided in a customization kit 121 that is available in the retail inventory 115 of the retail facility. Some of the items included in the customization kit 121 may include ink, stencils, guides, grommets, studs, a marker kit, a paint kit, shoe polishes, specialized laces, and jewels. Some of the tools included in the customization kit 121 may include sandpaper or other distressing tools, crimping tools, and tools for attaching studs, jewels, or grommets to a substrate. Accordingly, the customer is able to purchase the customization kit 121 at the cashier 120 within the retail facility and to customize any piece of apparel, such as the cured article of footwear 153, off the premises of the retail facility.

Figure 2:
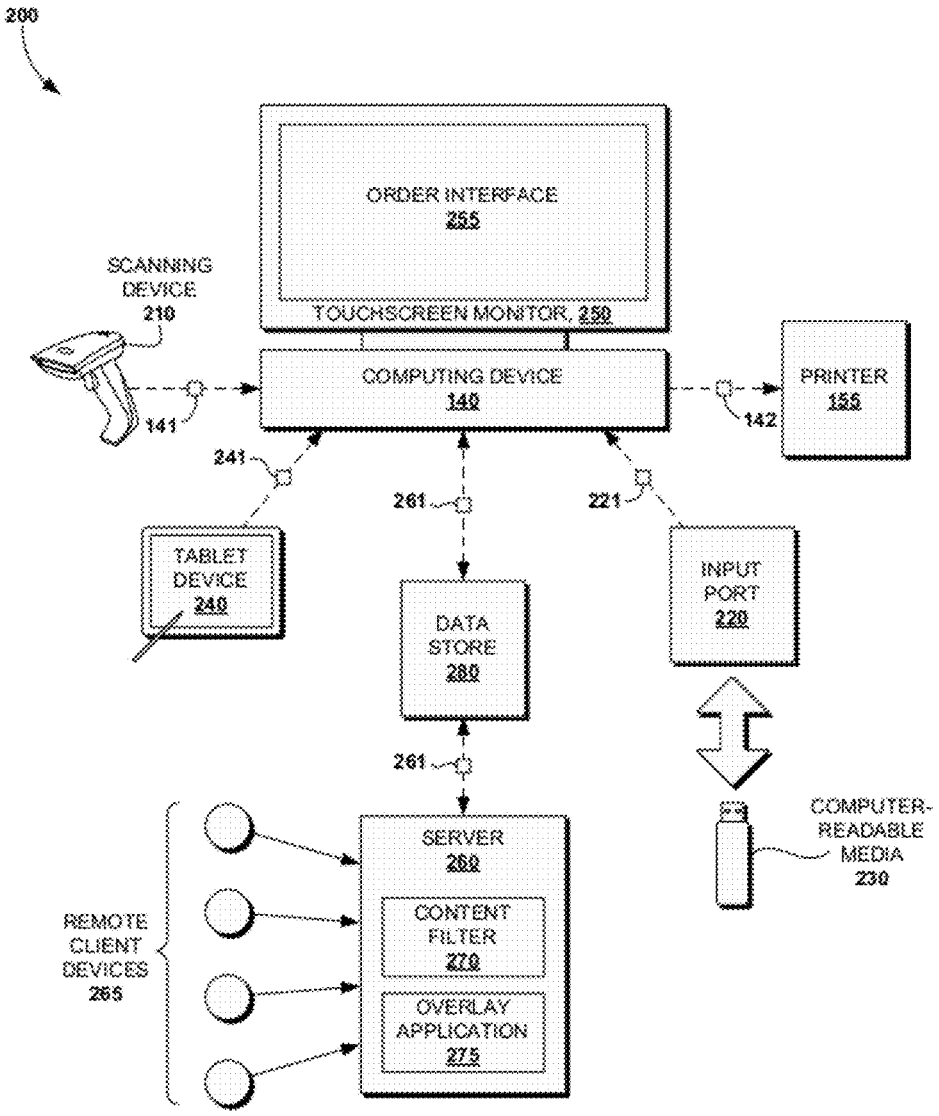
FIG. 2 is a block diagram of an exemplary system architecture suitable for use in implementing embodiments of the present invention.

Turning to FIG. 2, a block diagram is shown that illustrates an exemplary system architecture 200 suitable for use in implementing embodiments of the present invention. Initially, the system architecture 200 includes the computing device 140 communicatively coupled to a touchscreen monitor 250, a barcode scanner 210, an input port 220 that can accept and read computer-storage media 230, a tablet device 240, a server 260 reachable by remote client devices 265, and a data store 280. This exemplary system architecture 200 is but one example of a suitable environment that may be implemented to carry out aspects of the present invention, and is not intended to suggest any limitation as to the scope of use or functionality of the invention. Neither should the illustrated exemplary system architecture 200 be interpreted as having any dependency or requirement relating to any one or combination of the components 140, 210, 220, 230, 240, 250, 260, or 280 as illustrated. It will be understood and appreciated that the components 140, 210, 220, 230, 240, 250, 260, and 280 illustrated in FIG. 2 are exemplary in nature and in number and should not be construed as limiting. Accordingly, any number of components may be employed to achieve the desired functionality within the scope of embodiments of the present invention.

Further, the components of the exemplary system architecture 200 may be interconnected by any method known in the relevant field. For instance, the computing device 140, the data store 280, and the server 260 may be operably coupled via a distributed computing environment that includes multiple computing devices coupled with one another via one or more networks. In embodiments, the network (not shown) may include, without limitation, one or more local area networks (LANs) and/or wide area networks (WANs). Such networking environments are commonplace in offices, businesses, enterprise-wide computer networks, intranets, and the Internet. Accordingly, the network is not further described herein.

The computing device 140, the server 260, and the remote client devices 265 shown in FIG. 2 may take the form of various types of computing devices that have at least one processor in communication with memory. By way of example only and not limitation, each of the computing device 140, the server 260, and the remote client devices 265 may be a personal computer, desktop computer, laptop computer, handheld device, consumer electronic device, handheld device (e.g., personal digital assistant), various servers, and the like. It should be noted, however, that the invention is not limited to implementation on such computing devices, but may be implemented on any of a variety of different types of computing devices within the scope of embodiments of the present invention.

Figure 3:
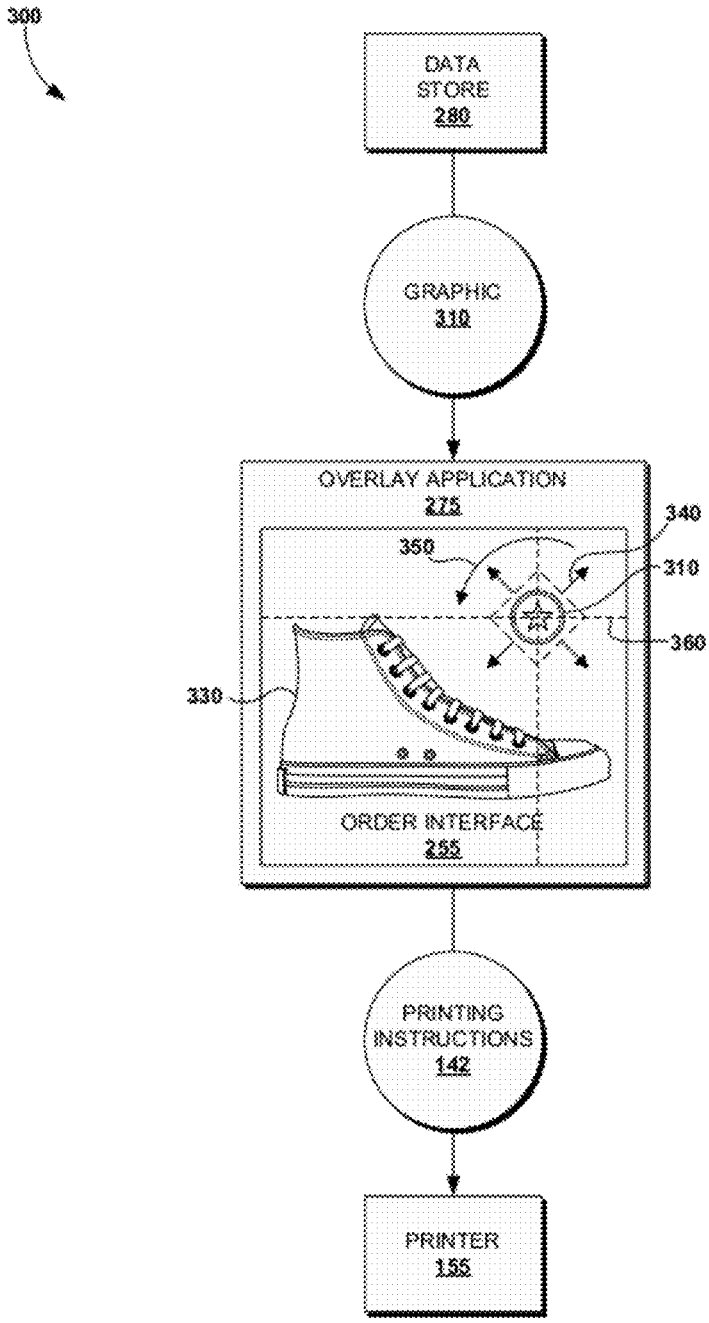
FIG. 3 is block diagram of an exemplary system for placing a graphic on a targeted portion of an article of footwear, in accordance with embodiments of the present invention.

The touchscreen monitor 250 is communicatively coupled to the computing device 140 and is capable of presenting an order interface 255 rendered by the computing device 140. In other embodiments, the touchscreen monitor 250 is configured to render and/or present a user-interface (UI) display thereon for displaying other information, such as a purchasing screen. Generally, the touchscreen monitor 250 may be configured as any presentation component that is capable of presenting information to a user, such as a digital monitor, electronic display panel, touch-screen, analog set top box, plasma screen, and the like. In one exemplary embodiment, the touchscreen monitor 250 is configured to present graphical content, such as a UI display that includes a display area populated with representations of a graphic and an article of footwear, as shown in FIG. 3.

The data store 280 is generally configured to store information associated with user-submitted orders and/or specifications included therein. In various embodiments, such information may include, predefined graphics selectable by a customer, customer-provided graphics submitted by a customer, the printing instructions 142 associated with graphics, and the like. In addition, the data store 280 may be configured to be searchable for suitable access of the stored information. For instance, the data store 280 may be searchable by the computing device 140 when rendering the order interface 255 or when converting the order into the printing instructions 142. The content and volume of such information are not intended to limit the scope of embodiments of the present invention in any way. Further, though illustrated as a single, independent component, the data store 280 may, in fact, be a plurality of databases.

In operation, the computing device 140 initially receives a graphic to be incorporated in the order from one or more mechanisms. In one instance, the scanning device 210 is configured to scan and communicate the barcode 141 to the computing device 140, where the barcode is associated with a graphic that is predefined and published in the catalog. In another instance, the input port 220, which is operably connected to the computing device 140, receives and reads the computer-storage media 230 provided by the customer, where one or more customer-provided graphics 221 reside on the computer-storage media 221. By way of example, and not limitation, the computer-storage media 230 may comprise flash memory, Random Access Memory (RAM), Read Only Memory (ROM), Electronically Erasable Programmable Read Only Memory (EEPROM), CDROM, digital versatile disks (DVDs) or other optical or holographic media, magnetic cassettes, magnetic tape, magnetic disk storage or other magnetic storage devices, or any other medium that can be used to encode desired information and be accessed by computing device 140.

In yet another instance, the computing device 140 can receive the graphic to be incorporated in the order from a tablet device 240. Typically, the tablet device 240 is operably connected to the computing device 140 and is configured allow an operator to draw one or more original graphics 241 thereon. Once the original graphics 241 are drawn, they can then be transmitted to the computing device 140 for incorporation into the order. Or, the tablet device 240 may be configured to trace a tangible image provided by the customer, wherein the traced image is communicated to the computing device 140 as the graphic to be incorporated into the order.

In operation, the server 260 may receive orders entered by customers at a web site hosted by the server 260. In embodiments, the customers may reach the web site via the remote client devices 265 and select options and graphics within an order interface supported by the web site. In particular instances, the order interface supported by the web site is configured to render options related to sizes and models, to present a display area for locating one or more selected graphics relative to the article of footwear (using an overlay application 275), and to identify selections of the options made by the customer. Upon the customer entering the order at the order interface within the web site hosted by the server 260, the server 260 may distribute the order to the computing device 140 at the retail facility that is selected by the customer, or most proximate to a residence/workplace of the customer.

In embodiments, the order interface supported by the web site can accept customer-provided graphics 261. When the server 260 identifies that the customer-provided graphics 261 are entered at the order interface, a content filter 270 may be invoked to ensure that the customer-provided graphics 261 do not contain offensive material, indicia of competitors, or obscene subject matter. If the customer-provided graphics 261 satisfy the content filter 270, the server 260 is further configured send the customer-provided graphics 261 to the data store 280 that persists the customer-provided graphics 261 for pre-defined timeframe before allowing the computing device 140 to access and process the customer-provided graphics 261. Securing the customer-provided graphics 261 in the data store 280 for the pre-defined timeframe allows for additional automated or manual review of the customer-provided graphics 261 to ensure no issues may arise if the customer-provided graphics 261 are affixed on a piece of apparel that also bears a logo or name of the customization company.

Turning now to FIG. 3, a block diagram is shown that illustrates an exemplary system 300 for placing a graphic 310 on a targeted portion of an article of footwear (shown digitally represented as 330), in accordance with embodiments of the present invention. As discussed above, the graphic 310 may be the customer-provided graphics 261 of FIG. 2 that are held in the data store 280 for a predetermined duration of time before being released for physical application to the article of footwear 330. Upon expiration of the duration of time, the overlay application 275 may access the graphic 310 and locate the graphic 310 on a portion of the article of footwear 310 targeted by the customer. As shown in FIG. 2, the overlay application 275 is running on the server 260, thereby allowing the customer to locate the graphic 310 on the article of footwear 310 at the order interface 255 rendered at a web site. However, the overlay application 275 may be installed in the computing device 140 of FIG. 1, which is located in the retail facility. In this instance, an operator may assist the user in locating the graphic 310 on the article of footwear 310 within the order interface 255.

In embodiments, locating the graphic 310 on the article of footwear 330 involves presenting a representation of the article of footwear 330 in a display area and presenting a representation of the graphic 310 in the display area as well. Once the representations of the graphic 310 and the article of footwear 310 are visually present, several operations may be conducted. These operations include translating a position 360 of the graphic 310 to overlay a targeted portion of the article of footwear 330, adjusting a rotational orientation 350 of the graphic 310, and/or resizing the original size 340 of the graphic 310. Resizing may be carried out manually, based on a preference of the customer, or automatically, according to an area associated with the targeted portion on the article of footwear 330.

As discussed above, once the proper adjustments are made to the position 360, the rotational orientation 350, and the size 340 of the graphic 310 at the order interface 255, these adjustments may be compiled as specifications within an order. The specifications may then be converted into the printing instructions 142 that are eventually communicated to the printer 155. Upon executing the printing instructions 142, the design may be physically applied to the article of footwear 330 in a configuration that corresponds to the position 360, the rotational orientation 350, and the size 340 of the graphic 310 as adjusted in the overlay application 275.

Figure 4:
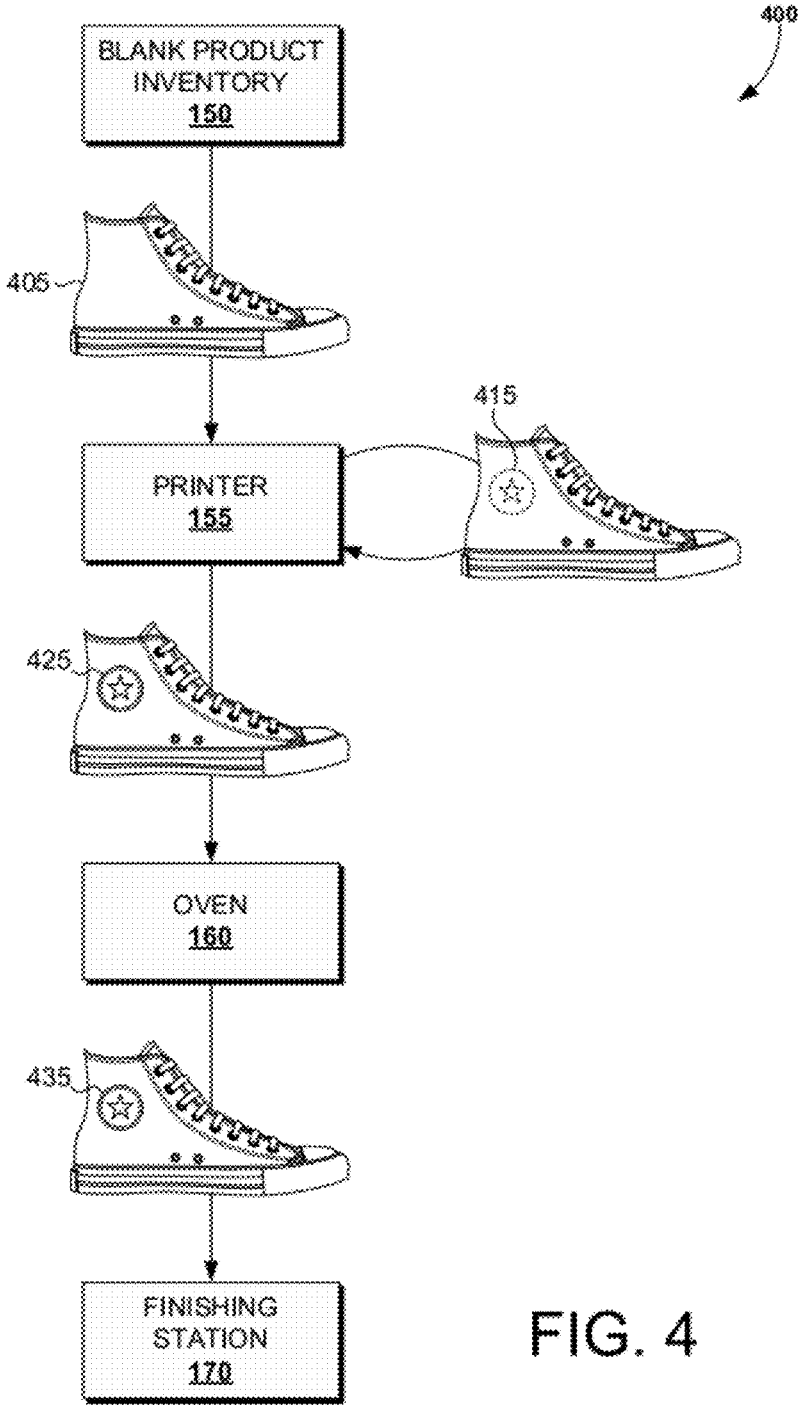
FIG. 4 is block diagram of an exemplary system for physically applying a design on the targeted portion of an article of footwear, in accordance with embodiments of the present invention.

With reference to FIG. 4, a block diagram of an exemplary system 400 for physically applying a design 425 on the targeted portion of an article of footwear 405 is shown, in accordance with embodiments of the present invention. Initially, the article of footwear 405 is selected by a customer from the blank product inventory 150. The article of footwear 405 is then placed into a loading zone of the printer 155, typically with a fixture assembled thereto. The printer 155 may physically apply the design 425 to the article of footwear 405 initially. Or, the printer 155 may perform one or more preprocessing steps before applying the design 425, such as applying a whitening agent, or primer 415, to the article of footwear 405. Accordingly, the primer 415 allows the coloring agent in the design 425 to sit on top of the substrate that comprises the article of footwear 405, as opposed to allowing the coloring agent to soak into the substrate and become unnoticeable.

Incident to physically applying the design 425, the article of footwear 405 is removed from the printer 155 bearing the design 425 in an uncured condition. In order to accelerated the drying of the coloring agent, the article of footwear 405 is placed into the oven 160, which heats the article of footwear 405 until the design 425 reaches the cured condition, as indicated at reference numeral 435. At this point, based on the specifications of the order, the article of footwear 405 may be delivered to the finishing station 170 for additional customization.

Once delivered to the finishing station 170, the article of footwear 405 may be further customized manually by the operator or automatically by one or more mechanisms that are configured to perform any number of various operations that add, subtract, or alter features of the article of footwear 405. These operations performed by the mechanism(s) and/or by the operator may be called for within the specifications of the order, or may be requested by the customer while present at the studio. Some of the possible operations that can be performed in the finishing station 170 include adding studs and/or jewels, perforating holes in a substrate comprising the article of footwear 405, attaching grommets, creating specialized laces and assembling them to the article of footwear 405, stitching or sewing fabric to the article of footwear 405, polishing or distressing, adding a customer-selected midsole, etching a design in the outsole, or applying additional coloring agent (e.g., painting a symbol or using a marker to sign the article of footwear 405). In this way, the operations carried out at the finishing station 170 can alter to article of footwear 405 to enhance aesthetic aspects as well as functional aspects thereof. Further, these operations can be performed to the article of footwear 405 before, during, or after, physically applying a design in the printer 155.

Although a single configuration of the design 425 has been illustrated in FIG. 4, which is a representation of a logo owned by the assignee of the present invention, it should be understood and appreciated that an unlimited number of other graphics or suitable designs may be applied to the article of footwear 405, or any other piece of apparel, and that embodiments of the present invention are not limited to those designs and graphics shown and described herein.

Figure 5:
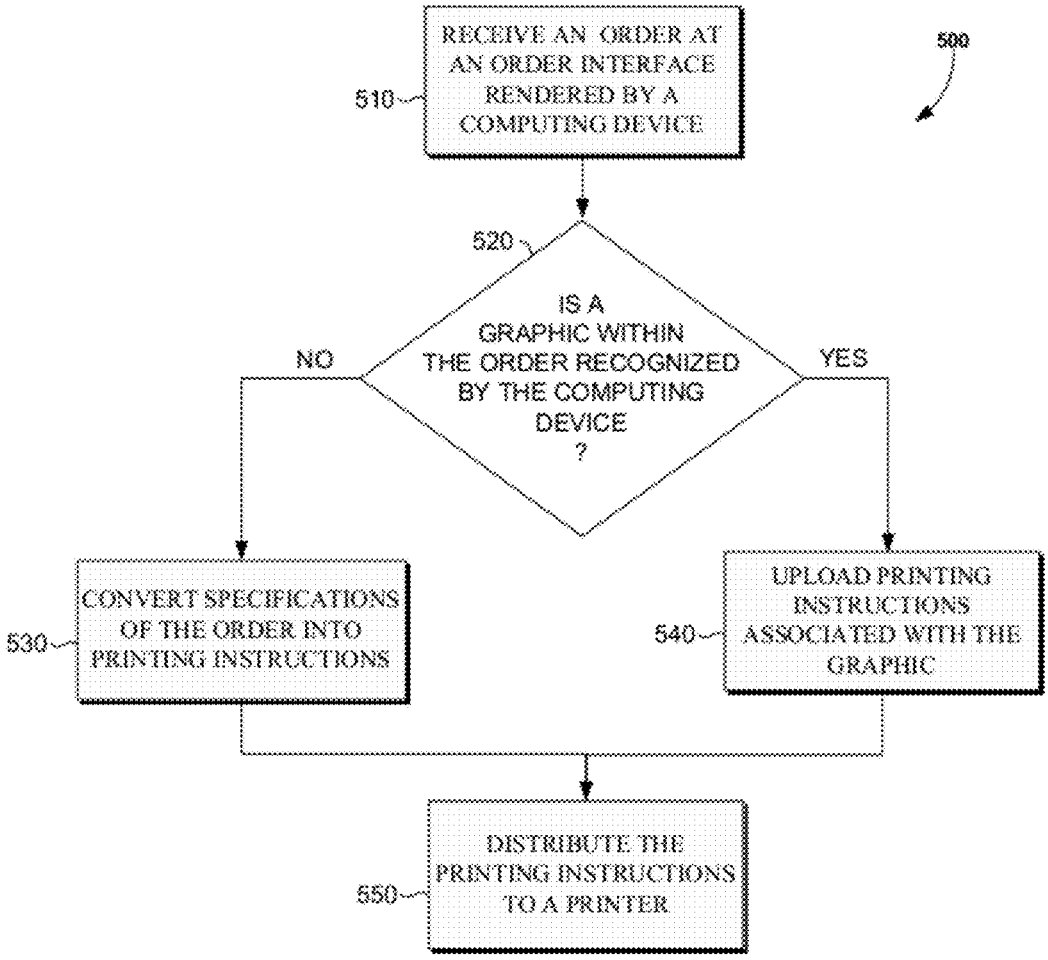
FIGS. 5 and 6 illustrate respective flow diagrams showing overall methods for customizing an article of footwear based on an order placed by a customer, in accordance with embodiments of the present invention.

Referring now to FIG. 5, a flow diagram is illustrated that shows an overall method 500 for customizing an article of footwear based on an order placed by a customer, in accordance with embodiments of the present invention. Initially, as depicted at block 510, an order is received at an order interface rendered by a computing device. Once received, the computing device may make a determination of whether a graphic within the order is recognized thereby, as depicted a block 520. In one instance, the computing device may recognize the graphic if the predefined graphic is presently stored in local memory or at a remote data store. However, a customer-submitted graphic will likely not be recognized. If the graphic is not recognized, the specifications of the order, including the position, size, and rotational orientation of the graphic are converted into printing instructions, as depicted at block 530. Otherwise, if the graphic is recognized by the computing device, printing instructions associated with the graphic are uploaded from local memory or the remote data store, as depicted at block 540. Once the printing instructions are either generated or uploaded, as depicted at block 550, they may be distributed to the printer for physical application of the design that resembles the graphic in the order.

Figure 6:
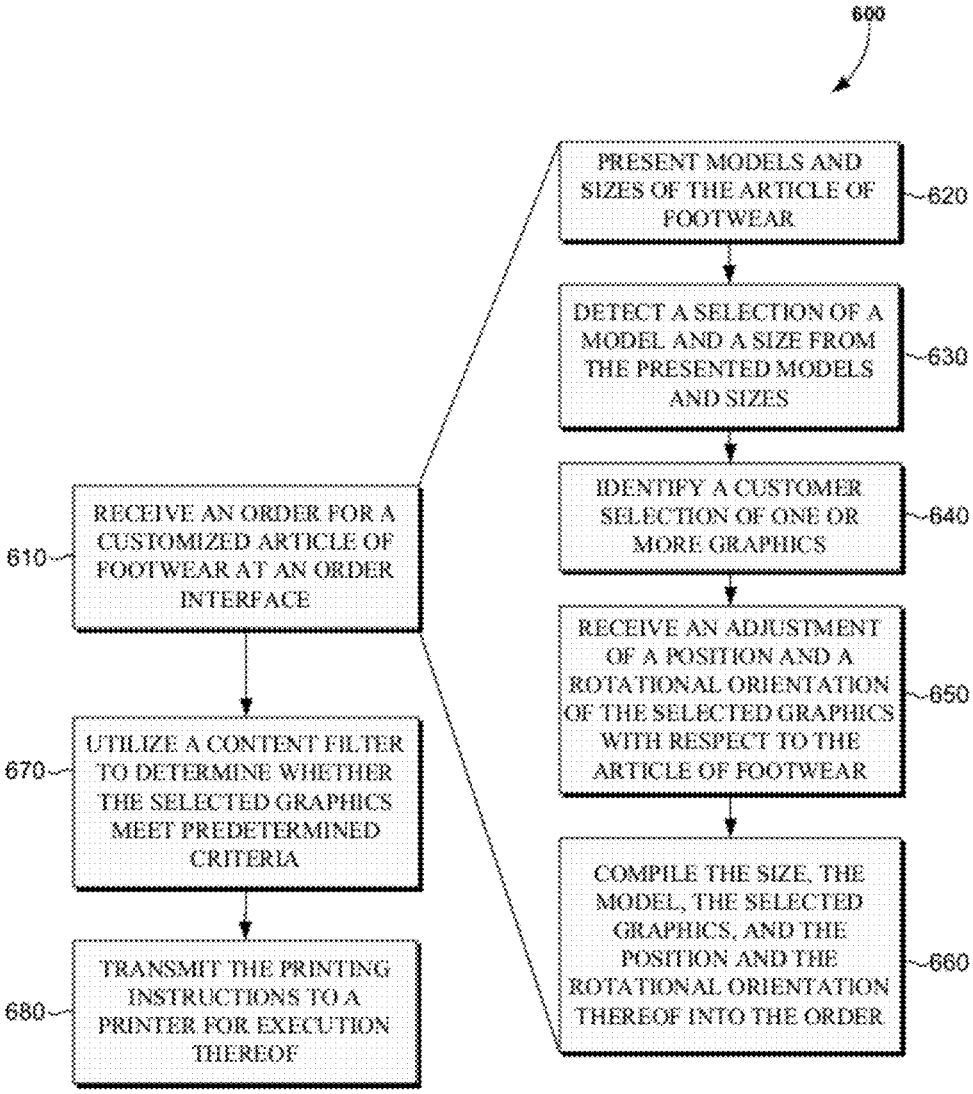

Referring now to FIG. 6, a flow diagram is illustrated that shows an overall method 600 for customizing an article of footwear based on an order placed by a customer, in accordance with embodiments of the present invention. Initially, as indicated at block 610, the order for the customized article of footwear is received at an order interface. An exemplary procedure for receiving the order may include one or more the following steps: presenting models and sizes of the article of footwear (see block 620); detecting a selection of a model and a size from the presented models and the presented sizes, respectively (see block 630); identifying a customer selection of one or more graphics (see block 640); receiving an indication of a position and a rotational orientation of the selected graphics with respect to the article of footwear (see block 650); and compiling the size, the model, the selected graphics, and the position and the rotational orientation thereof into the order (see block 660). The method 600 may further include the steps of utilizing a content filter to determine whether the selected graphics meet predetermined criteria, as depicted at block 670, and, upon ascertaining that the selected graphics satisfy the predetermined criteria, converting the order into printing instructions, as depicted at block 680. At some later time, the printing instructions may be transmitted to a printer for execution thereof. Upon executing the printing instructions, the printer causes a design to be physically applied to the article of footwear (exhibiting the size and the model selected by the customer), where the design generally resembles the selected graphics. Further, the design is substantially arranged in the position and the rotational orientation on the article of footwear, as specified by the order.

The present invention has been described in relation to particular embodiments, which are intended in all respects to be illustrative rather than restrictive. Alternative embodiments will become apparent to those of ordinary skill in the art to which the present invention pertains without departing from its scope. For instance, it should be understood and appreciated that embodiments of the present invention are not limited to articles of footwear, and that any piece of apparel may be utilized in the customization processes described above.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

The invention claimed is:

1. A system for performing a method for customizing a piece of apparel in a retail facility according to an order placed by a customer, the system comprising:

a computing device configured to receive the order including one or more graphics selected by the customer, and to convert the order into printing instructions, and to deliver the printing instructions to a printer in communication with the computing device;

an inventory of one or more preassembled blank three-dimensional products within the retail facility, wherein the piece of apparel represents at least one of the one or more preassembled blank three-dimensional products;

the printer within the retail facility to receive at least a portion of the piece of apparel within a loading zone, wherein the piece of apparel is selected by the customer from the inventory, and to operate an inkjet nozzle to release a coloring agent from the inkjet nozzle that physically applies a design on the portion of the piece of apparel, wherein a pattern and timing of the release of the coloring agent is controlled by the printing instructions, and wherein the design substantially replicates the one or more selected graphics; and an oven that has a chamber for receiving the piece of apparel that exhibits the design in an uncured condition, wherein the oven is configured to heat the piece of apparel until the design reaches a cured condition, and wherein the computing device, the printer, and the oven are each located in the retail facility.

2. The system according to claim 1, wherein the piece of apparel comprises at least one of an article of footwear, a garment, clothing, a bag, sports equipment, or accessories, and wherein the system further comprises a fixture that, when assembled to the piece of apparel within the loading zone of the printer, achieves a relatively flat section of the piece of apparel by stretching the section.

3. The system according to claim 1, further comprising a touchscreen monitor to support an order interface that is configured to render options for placing the one or more graphics on the piece of apparel and to identify selections of the options made by an operator, wherein the selected options are incorporated into the order.

4. The system according to claim 1, further comprising a catalog that presents a plurality of graphics and a plurality of bar codes that correspond with plurality of graphics, respectively, wherein the catalog is available to the customer for review at a sales counter in the retail facility.

5. The system according to claim 4, further comprising a scanning device to scan a barcode of the plurality of barcodes in the catalog, wherein the barcode corresponds to the one or more graphics, and wherein the catalog presents the barcode on a page in proximity to a representation of the one or more graphics.

6. The system according to claim 5, wherein, upon scanning the barcode, the scanning device is further configured to communicate the barcode to the computing device, and wherein the computing device establishes the order with the corresponding one or more graphics upon receiving the barcode communication.

7. The system according to claim 1, further comprising an input port, which is operably connected to the computing device, configured to receive and read computer-storage media provided by the customer, wherein the one or more graphics reside on the computer storage media.

8. The system according to claim 1, further comprising a finishing station to receive the piece of apparel exhibiting the design in the cured condition and to modify the piece of apparel in accordance with the order, wherein the finishing station is located in the retail facility.

9. The system according to claim 8, wherein modifying the piece of apparel in accordance with the order comprises at least one of adding studs, adding jewels, perforating holes, attaching grommets, lacing specialized laces, or applying additional coloring agent.

10. The system according to claim 1, further comprising a server to receive the order entered by the customer at a web site hosted by the server, and to distribute the order to the computing device at the retail facility that is selected by the customer.

11. The system according to claim 10, wherein the web site supports an order interface that is configured to render options for placing the one or more graphics on the piece of apparel and to identify selections of the options made by the customer from a remote client device, wherein the selected options are incorporated into the order.

12. The system according to claim 11, wherein the server is further configured to filter content of the order based on whether the one or more graphics included in the order contain offensive material, indicia of competitors, or obscene subject matter.

13. The system according to claim 12, wherein, upon the order satisfying the content filter, the server is further configured send the order to a data store that persists the order for pre-defined timeframe before allowing the computing device to access and process the order.

14. The system according to claim 13, wherein the computing device processing the order persisted at the data facility comprises:

downloading the order to a local memory on the computing device;

accessing the selected options within the order; and converting the selected options into the printing instructions, a work flow, and a sequence of operations, wherein the work flow indicates whether the printer, the over, or a finishing station are participants in fulfilling the order, and wherein the sequence of operations indicates the tasks that are performed at each of the participants.

15. The system according to claim 1, further comprising a tablet device, which is operably connected to the computing device, configured to draw the one or more graphics or to trace a tangible image provided by the customer, wherein the traced image is communicated to the computing device as the one or more graphics.

16. An article of footwear that is customized according to an order placed by a customer, the process of customizing comprising:

receiving the order for the article of footwear at an order interface rendered by a computing device, wherein the order includes specifications that pertain to one or more graphics, and wherein the article of footwear represents one or more preassembled blank three-dimensional products selected by the customer from inventory within a retail facility;

converting the specifications of the order into printing instructions;

distributing the printing instructions to a printer within the retail facility, wherein the printer is configured to receive the article of footwear within a loading zone, to read the printing instructions, to manipulate a pattern of movement of at least one inkjet nozzle based on the printing instructions, and to time a release of a coloring agent from the at least one inkjet nozzle based on the printing instructions, wherein a design is physically applied to contours of the article of footwear upon concurrently moving the inject nozzle and releasing the coloring agent therefrom, and wherein the design resembles the one or more graphics.

17. The article of footwear of claim 16, wherein the process of receiving the order further comprises:

retrieving options from a data store that comprise at least one of model options or size options;

rendering the retrieved options within an order interface; and receiving selections indicated by the customer that are directed toward one or more of the options.

18. The article of footwear of claim 16, wherein the process of receiving the order further comprises:

presenting a representation of the article of footwear in a display area;

presenting a representation of the one or more graphics in the display area;

translating the representation of the one or more graphics to overlay a targeted portion of the representation of the article of footwear;

adjusting a rotational orientation of the representation of the one or more graphics; and resizing the representation of one or more graphics according to an area associated with the targeted portion.

19. The article of footwear of claim 16, wherein converting the specifications of the order into printing instructions comprises deriving printing instructions, in part, from the representation of the one or more graphics, upon being translated, adjusted, and resized, such that, upon the printer executing the printing instructions, the design applied to the article of footwear resembles the representation of the one or more graphics upon being translated, adjusted, and resized.

20. A computerized method for customizing an article of footwear according to an order placed by a customer, the method comprising:

receiving the order for the customized article of footwear at an order interface, wherein receiving comprises:

(a) presenting models and sizes of the article of footwear that are currently available within a retail store's inventory of one or more preassembled blank three-dimensional products;

(b) detecting a selection of a model and a size from the presented models and the presented sizes, respectively;

(c) identifying a selection of one or more graphics;

(d) receiving an indication of a position and a rotational orientation of the one or more selected graphics with respect to the article of footwear;

(e) compiling the size, the model, the one or more selected graphics, and the position and the rotational orientation thereof into the order;

converting the order into printing instructions; and transmitting the printing instructions to a printer within the retail store for execution thereof, wherein upon executing the printing instructions, the printer causes a design to be physically applied to the article of footwear that is taken from the retail store's inventory and that exhibits the size and the model selected by the customer, wherein the design resembles the one or more selected graphics; and wherein the design is substantially arranged in the position and the rotational orientation on the article of footwear.

* * * * *